United States Patent [19]

Itzel

[11] Patent Number: 4,793,475

[45] Date of Patent: Dec. 27, 1988

[54] CLOSURE CAPS FOR TWO-COMPONENT PACKAGING SYSTEMS

[75] Inventor: Hanshelmut Itzel, Gau-Algeheim, Fed. Rep. of Germany

[73] Assignee: Celamerck GMBH & Co. KG, Ingelheim am Rhein, Fed. Rep. of Germany

[21] Appl. No.: 677

[22] Filed: Jan. 6, 1987

Related U.S. Application Data

[63] Continuation of Ser. No. 823,154, Jan. 27, 1986, abandoned.

[30] Foreign Application Priority Data

Jan. 26, 1985 [DE] Fed. Rep. of Germany ..... 3502580

[51] Int. Cl.[4] ..... B65D 81/32

[52] U.S. Cl. ..... 206/221; 206/219; 215/227; 215/DIG. 8

[58] Field of Search ..... 206/219–222, 206/568; 215/6, 10, 227, 228, 258, 329, DIG. 8; 220/23; 366/602; 604/415, 416

[56] References Cited

U.S. PATENT DOCUMENTS

| | | | |
|---|---|---|---|
| 1,918,307 | 7/1933 | Weber | 215/6 |
| 3,255,926 | 6/1966 | Modderno | 206/221 |
| 3,822,027 | 7/1974 | Cherba | 215/329 |
| 3,856,138 | 12/1974 | Maekawa et al. | 215/DIG. 8 |
| 4,024,952 | 5/1977 | Leitz | 206/221 |
| 4,132,308 | 1/1979 | Gonclayes | 215/DIG. 8 |
| 4,203,517 | 5/1980 | Hildebrandt | 206/221 |
| 4,386,696 | 6/1983 | Gonclaves | 206/219 |
| 4,591,050 | 5/1986 | Finke et al. | 206/222 |

FOREIGN PATENT DOCUMENTS

| | | | |
|---|---|---|---|
| 2754100 | 6/1978 | Fed. Rep. of Germany | 206/222 |
| 2506726 | 12/1982 | France | 206/222 |

*Primary Examiner*—Jimmy G. Foster
*Attorney, Agent, or Firm*—Felfe & Lynch

[57] ABSTRACT

Closure caps for binary packaging systems comprising an active ingredient concentrate component and a dilutent component, which allow the user to admix the two components without coming in contact with either of them or with the resulting mixture.

9 Claims, 7 Drawing Sheets

Figures 1, 1A:
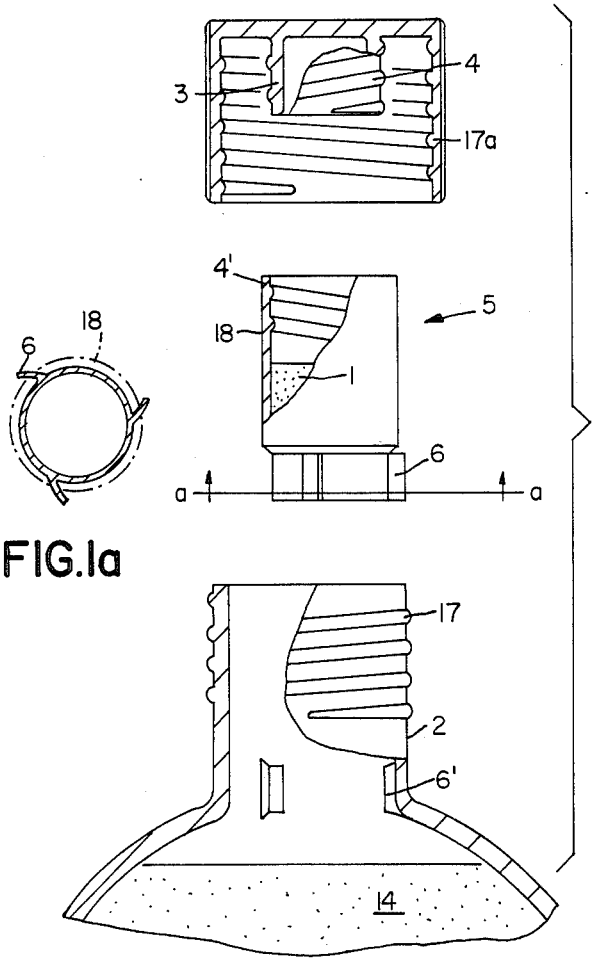

FIG.7a
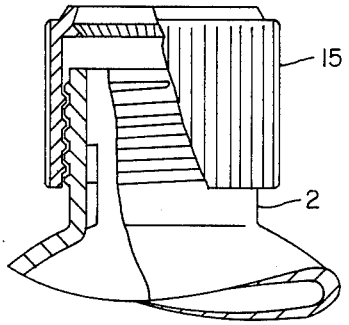
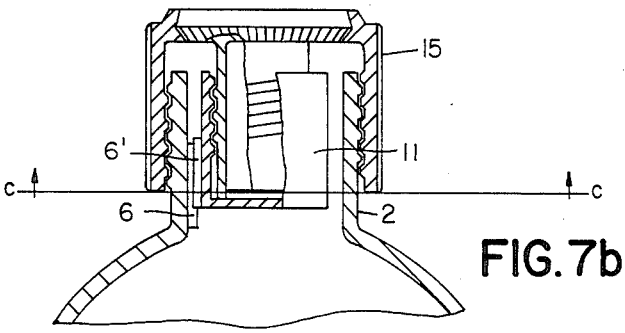
FIG.7b
FIG7c
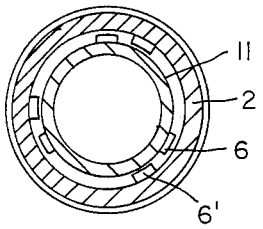
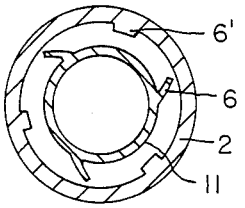
FIG.7d

CLOSURE CAPS FOR TWO-COMPONENT PACKAGING SYSTEMS

This is a continuation of copending application Ser. No. 823,154, filed Jan. 27, 1986, now abandoned.

FIELD OF INVENTION

This invention relates to closure caps for two-component packaging systems.

BACKGROUND OF THE INVENTION AND THE PRIOR ART

Two-component packaging systems wherein a vessel containing a diluent carries a closure cap containing a concentrate are known. By manipulating the closure cap the user is able to open a reservoir continuing the concentrate so that the concentrate and diluent are mixed together without the user coming into contact with the concentrate.

British Pat. No. 10 83 335 discloses an apparatus for storing and mixing two components in which a screw cap which carries a reservoir in which one component is enclosed is used as the closure cap. This reservoir is constructed as a small pot with a flat bottom and is placed on a collar extending radially from the base of the screw cap into the fill opening. When the cap is screwed up, the pot serving as a reservoir is held by means of an upper annular bead at a specific height in the neck of the bottle, while the lower edge of the collar tears off the base of the pot along a weakened line and thus enables the component stored in the bottle (referred to as a diluent herein) to be mixed with the component stored in the reservoir (hereinafter referred to as the concentrate).

Furthermore, German Gebrauchsmuster No. 75 31 452 discloses a similar device in which the part of the closure cap constructed as a reservoir consists of a cylindrical wall element projecting into the neck of the bottle and sealed off at the top by a base of the closure cap and at the bottom by a base plate which can be put on. The base plate is pressed towards the wall element by means of a retaining member extending from the base of the closure cap so as to form a chamber which is outwardly sealed.

These known closure caps have a number of disadvantages which affect the usefulness of the two-component package:

The components, which are stored side by side in the reservoir and bottle, are not reliably separated from each other. If, for example, liquids such as plant pesticide concentrates and a diluent or other organic solvents or emulsifiers are present as one component of the two-component system, there are problems of leaktightness particularly at the weakened breakage point at the closure between the collar and the reservoir or at the closure between the base plate and the wall element.

Moreover, some of the two-component packages disclosed in the prior art can be opened by simply unscrewing the closure cap, and the two components can be removed separately from each other. However, the intent of two-component packages is often that it should only be possible to remove the finished mixture of the two components. Separation into the individual components is contrary to the safe use which the two-component package is intended to ensure.

In the closure caps described in the prior art the reservoir may only be manufactured from certain materials, which may vary depending on the type of closure cap, the rigidity of the base plate, the leaktightness of the clip stages used as sealing elements or the weakened point, thereby greatly restricting the choice of materials with regard to mechanical properties.

OBJECTS OF THE INVENTION

According to the invention, it is an object to provide two-component packaging systems in which the disadvantages described above are avoided.

Other objects and advantages of the present invention will become apparent as the description thereof proceeds.

DESCRIPTION OF THE INVENTION

Referring generally to the attached drawings, the above object is achieved by a closure cap for two-component packages, containing a reservoir intended to receive a concentrate (1), where (a) the closure cap rotatable on the neck of the bottle (2) has a collar (3) extending radially into the bottle neck (2) from the base of the closure cap, and (b) the collar (3) is arranged, by means of a collar thread (4), to receive an inner container (5) containing the concentrate (1), and ($c_1$) between the outer wall of the inner container (5) and the inner wall of the bottle neck (2) a rotation block (6,6') is provided at one or more points which prevents free rotation of the inner container (5) in one or both directions of rotation, or ($c_2$) the collar (3) is angular or pointed in construction to form an abutment edge (7) at its lower end and rests on the base (8) or on an annular step (9) extending about a divisible internal container (11) in such a way that when the inner container (11) screwed onto the collar thread (4) is rotated further in the direction of closure of the collar thread (4), the inner container (11) is severed along a weakened line (10), while ($c_{2.1.}$) the free rotation of the inner container (11) is impeded in one or both directions by one or more rotation blocks (6,6') mounted on the outer wall of the inner container (11) and on the inner wall of the bottle neck (2), or ($c_{2.2.}$) the inner container (11) comprises, on its upper portion, an annular bead (12) which is directed radially outwardly and abuts on the bottle neck (2), this annular bead defining the depth of suspension of the inner container (11) and possibly blocking the free rotation of the inner container (11) by means of knobs or notches (13).

By the interaction of the elements according to this invention specified above, it is possible to produce closure caps in which the inner container (5) acting as reservoir is unscrewed by rotary movements of the closure cap from the collar thread (4) [combination of elements (a), (b) and ($c_1$)] or in which the inner container (11) is severed by the lower part of the collar (3), which is constructed as an abutment edge (7), so that the reservoir opens towards the diluent (14) stored in the bottle [combination of elements (a), (b), ($c_2$) and ($c_{2.1.}$) or ($c_{2.2.}$)]. Further advantageous effects are achieved in addition to the improvements over the prior art required according to the objective of this invention.

In particular, specific illustrative embodiments of the closure cap according to the invention are described below without restricting the scope of the invention to the embodiments. It should be particularly emphasized that the concrete form of individual elements described by way of example in the illustrative embodiments may readily be transferred to other embodiments of the closure cap according to the invention by those skilled in the art, and may be used to achieve a particular part of the overall object.

The closure cap for two-component packaging systems according to the present invention is explained more fully with reference to the drawings, of which FIG. 1 is an exploded view of one of the preferred embodiments consisting of a bottle neck (2), a screw cap with an unscrewable inner container (5) and a rotation block (6,6') acting in one direction of rotation.

FIG. 1*a* is a cross-section through the inner container (5) along line a—a in FIG. 1.

Figure 2A:
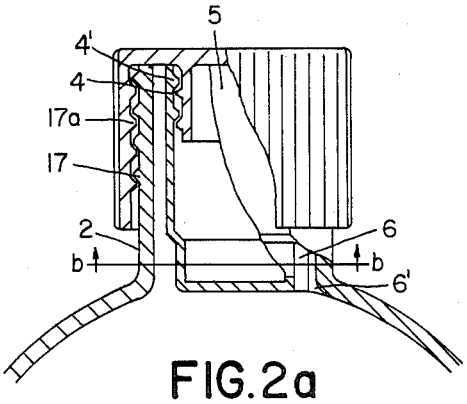

FIG. 2*a* is a side view, in partial cross-section, of the assembled closure cap assembly of FIG. 1 comprising a bottle neck (2) having a screw cap with an unscrewable inner container (5) and a rotation block (6,6') effective in one direction of rotation.

Figure 2B:
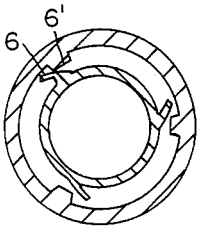

FIG. 2*b* is a cross-section through a rotation block along line b—b of FIG. 2*a* which blocks rotation in one direction.

Figure 2C:
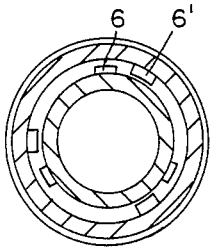

FIG. 2*c* is a cross-section through a rotation block along line b—b of FIG. 2*a* which blocks rotation in both directions.

Figure 3:
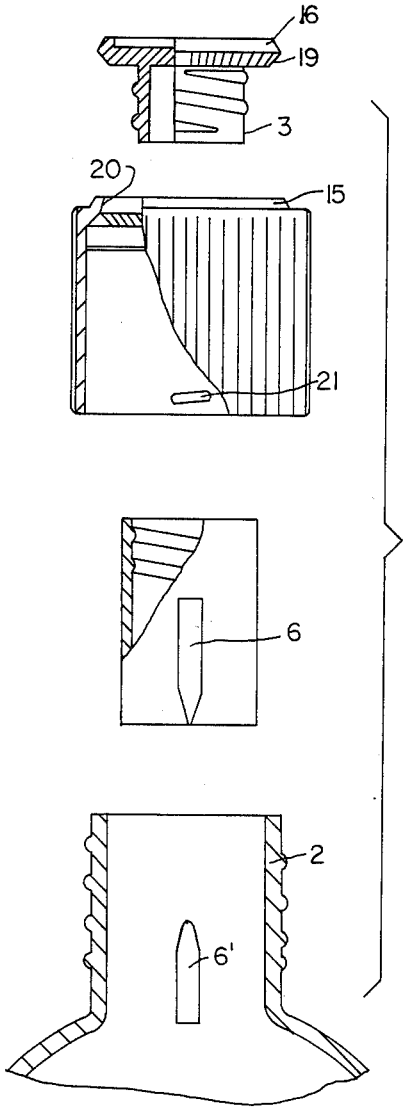

FIG. 3 is an exploded view of another preferred embodiment of a closure cap, consisting of clip-in base (16), clip-in cap (15), unscrewable inner container (5) and bottle neck (2).

Figure 4A:
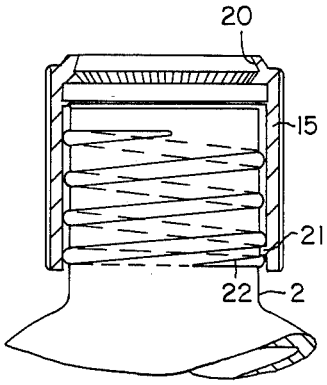

FIG. 4*a* shows a bottle neck (2) with clip-in cap (15) screwed on.

Figure 4D:
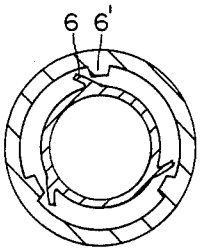
Figure 4C:
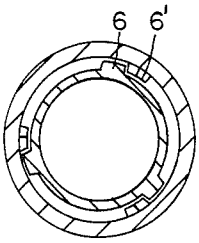
Figure 4B:
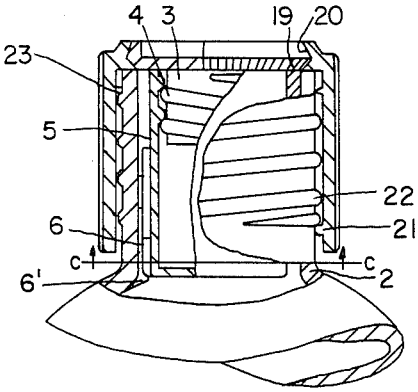

FIG. 4*b* shows a bottle neck (2) with closure cap in its state ready for use before the internal container (5) has been unscrewed.

FIG. 4*c* is a cross-section along line c—c of FIG. 4*b* through a rotation block (6,6') blocking rotation in one direction.

FIG. 4*d* is a cross-section along line c—c of FIG. 4*b* through a rotation block (6,6') blocking rotation in one direction.

Figure 5A:
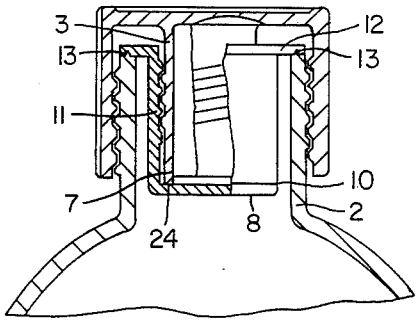
Figure 5:
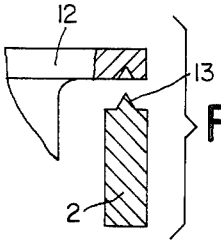

FIG. 5*a* shows a bottle neck (2) with screw cap and divisible inner container (11).

Figure 5B:
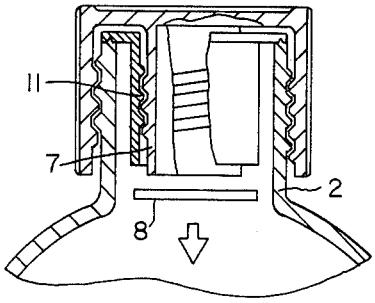

FIG. 5*b* shows a bottle neck (2) with screw cap and divided inner container (11).

FIG. 5*c* is an exploded view of a detail of FIGS. 5*a* and 5*b*.

Figure 6:
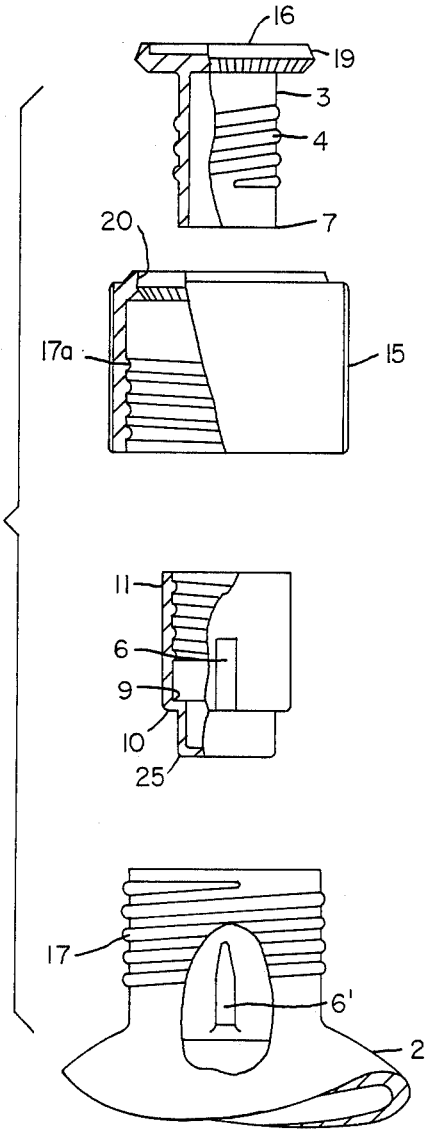

FIG. 6 is an exploded view of a closure cap consisting of click-in base (16), click-in cap (15), a divisible inner container (11) deep base (25) and bottle neck (2).

Figure 6A:
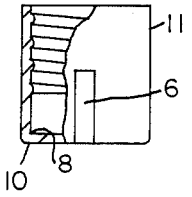

FIG. 6*a* shows a divisible inner container (11) with flat base (8).

FIG. 7*a* shows a bottle neck (2) with click-in cap (15) screwed on.

FIG. 7*b* shows a bottle neck (2) with closure cap in the position ready for use before severing of the divisible internal container (11).

FIG. 7*c* is a cross-section along line c—c of FIG. 7*b* through a rotation block (6,6') effective in both directions of rotation.

FIG. 7*d* is a cross-section along line c—c of FIG. 7*b* through a rotation block (6,6') effective in only one direction of rotation.

FIG. 1 shows an embodiment of the closure cap according to this invention in which the cap can be screwed to the bottle neck (2) by means of a thread, hereinafter referred to as the bottle thread (17). The inner container (5) is held in the closure cap by a thread associated with the collar (3) and is hereinafter referred to as the collar thread (4). A number of flexible rotation blocks (6) extending outwardly in the manner of flaps or wings are associated with the outer surface of the inner container (5) in such a way that the outer edge of the rotation block (6) projects beyond the outer surface (18) of the inner container (5) and slides past the rotation blocks (6') associated with the bottle neck (2) in one direction of rotation, in the manner of a ratchet; but will not move in the opposite direction of rotation.

Preferably, the flexible rotation blocks (6) are associated with the inner container (5) and the angular rotation blocks (6') are associated with the bottle neck (2). This simplifies the manufacture of the bottle. Furthermore, if the bottle is to be used a number of times, the flexible rotation blocks (6) which wear out more quickly are associated with the inner container (5) which is usually used only once. Moreover, with this arrangement, the clear space in the bottle neck can be used to an optimum degree, that is, the space between the outer surface of the inner container and the inner wall of the bottle neck (2) can be restricted to a narrow slot; this is particularly true if the lower portion of the inner container tapers as shown in FIG. 1.

In this way, best possible use can be made of the volume available for the concentrate (1) in the inner container in relation to the useful inner space of the bottle neck.

FIG. 2*b* diagrammatically shows a cross-section through the bottle neck and inner container level with the rotation blocks (6) and (6').

By combining the elements of bottle thread (17), collar thread (4) and rotation block (6,6') effective in one direction, it is possible to produce closure caps for a variety of applications: the rotation block (6) acting in one direction, associated with the inner container (5) in FIGS. 1 and 2, is arranged so that it blocks the direction of rotation, which results in the inner container (5) being unscrewed from the collar (3). Moreover, collar thread (4) and bottle thread (17) are dimensioned relative to each other in such a way that the inner container (5) can be screwed up and unscrewed with fewer turns than are necessary in order to screw up the closure cap entirely by means of the bottle thread (17). Bearing these conditions in mind, the following possible combinations arise:

Collar thread (4) and bottle thread (17) have different directions of rotation, for instance, collar thread (4) is left-handed and bottle thread (17) is right-handed: when the closure cap containing the inner container (5) and the concentrate (1) is screwed up, the inner container (5) is unscrewed from the collar thread (4) and the concentrate (1) mixes with the diluent (14).

In the second instance, the collar thread (4) and bottle thread (17) have the same direction of rotation, for example, both are right-handed, and in this case the closure cap containing the inner container (5) and the concentrate (1) can be closed until a fixed abutment is obtained, as shown in Fi.. 2*a*, and when the closure cap is unscrewed, the inner container (5) is simultaneously unscrewed from the collar thread (4). The concentrate (1) mixes with the diluent (14) before the bottle is opened.

The combination of individual features described hereinbefore is particularly suitable for a safety packaging system: concentrate (1) and diluent (14) are packaged by the manufacturer in the closure cap and bottle, the two parts are screwed together and sold as a sealed unit. Since the concentrate (1) and diluent (14) are mixed together as the closure is unscrewed, before the bottle has been opened for removal of the contents, it is impossible to remove the concentrate (1) in undiluted form. This feature is of exceptional importance particularly when packaging concentrated pesticides for plants. The manufacturer can offer packages for sale in which the pesticidal liquor ready for use or a semiconcentrate requiring further dilution is only formed at the moment of opening the package.

Since the ratio of concentrate (1) and diluent (14) is determined by the manufacturer, any incorrect dosages caused by the user are prevented. Another important point is the fact that in packages of this kind the concentrate (1) cannot be accidentally taken out in undiluted form. The term "safety closure cap" is used herein whenever the combination of elements according to the present invention results in a closure cap with which the concentrate cannot be removed undiluted when the closure cap is previously placed on the bottle neck and unscrewed from the bottle neck by normal handling.

Closure caps with an unscrewable inner container (5) may also be fitted with rotation blocks which prevent rotation in both directions.

The features of this type of closure cap will now be explained with reference to FIG. 3 and FIGS. 4*a, b, c* and *d:*

FIG. 3 shows an inner container (5), the outer surface of which is associated with a plurality of radially outwardly pointing webs forming a rotation block (6). Matching webs are provided as rotation blocks (6') in the bottle neck (2). The closure cap associated with the bottle neck (2) may consist of two parts as shown in FIG. 3. One part, hereinafter referred to as the click-in cap (15) is associated with the bottle neck (2) and comprises on the base of the cap an edge member arranged to receive the base element carrying the collar (3), this base element being hereinafter referred to as the click-in base (16). The recess in the base of the click-in cap (15) is dimensioned so that the inner container (5) screwed to the click-in base can be pushed through until the click-in base (16) abuts firmly in the click-in cap (15). Divided closure caps of this kind are particularly suitable as safety closure caps.

The filling and sealing and the proper use of a system of this construction will now be explained in more detail with reference to the drawings in FIGS. 4*a–d:*

The manufacturer first screws the click-in cap (15) onto the bottle filled with the diluent (14). In a separate operation, the inner container (5) filled with the concentrate (1) is screwed tightly to the click-in base (16) and inserted through the upper opening in the click-in cap (15), which is already resting on the bottle neck, so that the rotation blocks (6) and (6') are offset relative to each other. The parts of the click-in closure associated with the click-in cap (15) and the click-in base (16), namely the matching edge members (20) and (19), are arranged so that after the base (16) has clicked into the cap (15) they are fixedly connected to one another and cannot be opened from outside.

By combining the collar and bottle threads (4) and (17) the following effects can be achieved: collar thread (4) and bottle thread (17) run in the same direction:

When the closure cap is unscrewed, the inner container (5) is simultaneously unscrewed from the collar thread (4), and the concentrate (1) mixes with the diluent (14) before the bottle is opened.

It is particularly advantageous to combine threads of different directions of rotation, for instance, collar thread (4) is left-handed and bottle thread (17) is right-handed.

The bottle thread is constructed so that in the bottom position (closed position) it can be further rotated idly in the direction of closure. Threads of this kind are part of the prior art. It is simple by this method to ensure that, for example, the bottle neck (2) is associated with a complete thread, while the closure cap has several radially arranged lense-shaped thread webs (21) at a certain height only in the lower region of the closure cap, these thread webs (21) traveling idly when the cap is screwed up in the direction of closure at the lowest thread turn of the bottle thread and being guided by the thread webs (22) of the bottle neck (2) when the closure cap is opened.

As a result of rotation blocks (6) and (6'), rotary movements in order to open the closure cap cause a rotary movement in the direction of closure to be transmitted to collar thread (4). Thus, in the case of an inner container (5) resting firmly on collar (3), the closure cap cannot be unscrewed. Instead, the closure cap must be deliberately turned further in the direction of closure until the inner container (5) is unscrewed from collar (3). Only then is it possible to open the bottle, that is, unscrew the closure cap.

A safety closure cap operating on the principle described above need not necessarily be produced in the divided form of the embodiment, that is, with a click-in cap (15) and click-in base 116). With modern packaging technology it is also possible to press closure caps in which the inner container (5) containing the concentrate (1) is provided with rigid rotation blocks (6,6') and is already fixedly screwed to the collar thread (4) of the closure cap, onto the bottle neck vertically or with gentle rotation so as to achieve a sealed leaktight closure without the rotation blocks (6,6') preventing the closure cap from being pressed on.

Divisible closure caps, on the other hand, have numerous advantages:

(a) little contact pressure is required to press in the click-in base (16) and (b) in the case of closure caps with collar and bottle threads extending in opposite directions or with bottle and collar threads having different thread pitches, expensive divisible tools have to be used to produce integral closure caps by injection molding. Owing to the different pitches of the bottle and collar threads (17), (4), it is not easy to unscrew the workpiece from the mold. On the other hand, it is easy to produce the parts of the closure cap which carry the collar thread (4) and the bottle thread (17) in separate operations and then join the two parts together, possibly by a click-in closure.

The seam of the click-in closure (19, 20) may, if desired, be sealed with hydrophobic adjuvants such as silicones or welded by heat treatment.

To improve the seal, one or more sealing lips (23) may be provided in the upper part of the closure cap above the bottle thread.

The invention also includes closure caps for two-component systems having an inner container (11) which is capable of being severed by the rotary movements; concrete embodiments of this type are shown in FIGS. 5*a, b* and *c,* 6 and 6*a,* and 7*a, b, c* and *d.*

In the closure cap disclosed in British Pat. No. 10 83 335, the separable inner container is fitted onto the smooth cylindrical outer surface of the collar. Even when sealing lips in the form of clip stages are used, the concentrate enclosed in the inner container cannot be stored with absolute certainty. Concentrates such as concentrated plant pesticides generally contain a large proportion of emulsifier and/or a solvent with good solvating properties. Partly as a result of capillary action, also, the concentrate rises up at the sealing surface between the inner container and the collar. This leakage point cannot be remedied either by using sealing lips in this region or by applying sealing rings. Moreover, the concentrate is in constant contact with the weakened breaking point of the inner container. The plastics material swells and the weakened point changes in its mechanical properties. Furthermore, even a short-lived rise in the storage temperature, caused by volatile components of the solvent in the concentrate, can lead to the build-up of such a high internal pressure in the reservoir that the fitting of the inner container on the collar is loosened.

This problem is not solved with the features disclosed in German Gebrauchsmuster No. 75 31 452.

The sealing problems are particularly noticeable here because the joint produced by clip stages between the base plate and the wall element must not lock too tightly since otherwise the base plate would not drop away when the seal is broken.

Whereas in the closure caps of this invention previously described which are fitted with an unscrewable inner container, the reservoir is opened when the inner container (5) is unscrewed from the collar thread (4), in the second alternative embodiment according to the invention having a separable inner container, the inner container (11) has to be screwed further onto the collar thread (4) so that the lower part of the collar (3) acting as an abutment edge (7) severs the inner container (11), the separation preferably occurring along a thinner part of the wall of the inner container, referred to as a weakened point (10). A particularly important feature compared with the prior art is the fact that the collar thread (4) also acts as a sealing element.

The collar thread (4), bottle thread (17) and rotation block (6,6') may in turn be combined in different ways and used for closure caps with a separable inner container.

In the embodiment described in FIGS. 5*a*, *b* and *c*, the collar thread (4) and bottle thread (17) have the same direction of rotation and the same pitch. The rotation block is formed by an annular bead (12) extending radially outwards from the upper end of the inner container, the bead being of such dimensions that i abuts on the upper edge of the bottle neck (2). In the preliminary closure position (FIG. 5*a*) the closure cap containing the concentrate, is screwed up until the annular bead (12) rests on the bottle neck. By further turning the closure cap in the direction of closure, the inner container (11) is screwed more firmly onto the collar thread (4), so that the lower part of the collar (3) constructed as an abutment edge (7) severs the inner container (11) along the weakened point (10) and thus empties the reservoir into the diluent (14) (FIG. 5*b*).

The annular bead (12), which simultaneously acts as a seal and a rotation block during the preliminary or definitive closing of the bottle (FIGS. 5*a* and 5*b*), may, on the one hand, block the rotation of the inner container (11) solely by the contact pressure acting on its abutment surface. It is also possible to provide the abutment surface between the annular bead (12) and the other edge of the bottle neck (2) with knobs, notches or zigzags (13), so that the free rotation of the inner container (11) is blocked even if there is only a little or no contact pressure.

The inner container (11) screwed to the collar (3) rests, by means of the collar thread (4), so firmly on the collar (3) that sealing rings (24) can be inserted to seal the inner container. The concentrate (1) cannot affect the weakened point (10) during storage and cause it to swell up, nor can any volatile components in the concentrate loosen the fit of the inner container (11) on the collar (3) by producing a high internal pressure.

FIGS. 6, 6*a* and 7*a–d* show embodiments of closure caps according to the invention with separable inner containers (11), in which the rotation blocks (6) and (6'), as already explained in detail hereinbefore, are arranged on the outer surface of the inner container (11) and on the inner surface of the bottle neck (2) as blocking elements acting in one direction (FIG. 7*d*) or in both directions of rotation (FIG. 7*c*).

In contrast to the embodiment dealt with in FIGS. 5*a*, 5*b* and 5*c* in which the depth of suspension of the inner container is defined by the annular bead (12) abutting on the bottle neck (2), the inner container in the embodiments shown in FIGS. 6, 6*a* and 7*a–d* is freely movable in the vertical direction inside the bottle neck (2) in accordance with the pitch of the collar thread (4). Thus, closure caps with separable inner containers (11) can be made available, in which the collar thread (4) and bottle thread (17) have different pitches. The interaction of the individual elements will be explained more fully by way of example with reference to a two-part closure cap with a separable inner container (11).

FIG. 6 shows, spatially separated, the individual elements click-in cap (15) with a click-in base (16) which can be pressed into it, the collar (3) constructed as an abutment edge (7) at its lower edge, comprising the collar thread (4) arranged to receive the inner container (11), and two embodiments of a separable inner container with a flat base (11) and with a tub-shaped base (25) tapering along an annular step (9) and the bottle neck (2) arranged to receive the closure cap by mean of a bottle thread (17). The rotation blocks associated with the inner container (11) and the bottle neck (2) are shown as rigid rotation blocks (6) and (6').

FIGS. 7*a* and *b* show the assembly of FIG. 6 in assembled condition.

First of all, the manufacturer fills the bottle with the diluent (14) and screws the click-in cap (15) onto the fill opening (2) as shown in FIG. 7*a*. In a second operation, the click-in base (16) which is screwed to the inner container (11) and which contains the concentrate (1) is inserted through the upwardly open base of the click-in cap (15) so that the edge members (19 and 20) formed as a closure engage. If desired, the click-in closure may be protected from unauthorized opening by adhesive bonding or sealing.

FIG. 7*b* shows the closure cap resting on the bottle neck (2) in the position ready for use. The closure cap need not necessarily consist of the two elements of click-in base (16) and click-in cap (15); it may also be made in one piece and the bottle is then sealed by pressing until it rests firmly on the bottle thread. Such methods are well established in packaging technology and need not be explained in detail. When the closure cap is pressed on directly in the vertical direction a lense-shaped partial thread (21) associated with the closure cap, as shown in FIG. 3, is preferred.

The closure cap shown in its position ready for use in FIG. 7*b* may, if desired, be additionally sealed by means of sealing lips on the click-in cap (15), bottle neck (2), collar (3) or inner container (11) to prevent the contents of the bottle from running out.

If the bottle thread (17) and collar thread (4) have opposite directions of rotation, then when the closure cap is unscrewed the inner container (11) is screwed more tightly to the collar (3), the abutment edge (7) resting on the base (8) or on the annular step (9) of the inner container (11) severs the inner container (11) along the weakened line (10) and the concentrate (1) and diluent (14) are mixed together even before the closure cap has been unscrewed. The combination of collar and bottle threads (4), (17) extending in the same direction is also feasible: from the closed position (FIG. 7*b*) it must be screwed up deliberately further in the direction of closure in order to sever the inner container (11), which will be apparent to the user by the sudden reduction in the force necessary to turn the cap. This effect occurs with all screw caps with a separable inner container (11) and can be regarded as a reliable indication that the concentrate (1) and diluent (14) have been mixed.

When in the case of collar and bottle threads (4, 17) rotating in the same direction, the inner container can be unscrewed from the collar (3) with fewer turns than are necessary to open the bottle completely, the inner container (11) falls away even before the closure cap is fully unscrewed, the concentrate (1) and diluent (14) are mixed together, and therefore the concentrate (1) cannot be removed in undiluted form.

Thus, both closure caps with the collar and bottle threads (4, 17) running in opposite directions and also closure caps in which the threads are in the same direction satisfy the requirements which are imposed on safety closure caps.

Moreover, closure caps with a separable inner container (11) and rotation blocks (6,6') acting in one direction (FIG. 7*d*) are also subjects of this invention. The rotation block (6,6') effective in one direction, which may be provided both on the outer surface of the inner container (11) (FIG. 7*d*) and also on the inner surface of the bottle neck (2), is arranged to block the direction of closure of the collar thread (4) and not the direction of unscrewing. Although rotation blocks effective in one direction may also be used in two-part closure caps, the use of this rotation blocking element is preferred in one-part closure caps. Where the thread of the collar and bottle are in the same direction, the rotation block (6,6') acts to block the screwing up of the closure cap.

The inner container (11) is screwed onto the collar (3) and severed along the weakened line (10) by means of the abutment edge (7). Closure caps of this kind satisfy the requirements for a two-component system in which the closure cap containing the concentrate is sold separately from the bottle and the bottle and closure cap are only combined by the final user.

In another embodiment, the collar and bottle threads (4, 17) rotate in opposite directions. This embodiment satisfies the requirements imposed on a safety closure cap system: the manufacturer screws the closure cap containing the concentrate (1) to a bottle into which the diluent (14) has already been poured. The rotation block (6,6') effective in one direction (FIG. 7*d*) does not block this operation since in the case of threads in different directions the "close" direction of rotation for the bottle thread (17) indicates a non-blocking sliding of the flexible block (6) over the corresponding rotation block (6'). Only when the sealed bottles are opened by the user does the rotation block (6,6') act, the inner container (11) is screwed onto the collar (3) and the abutment edge (7) severs the reservoir along the weakened line (10).

A major advantage of closure caps with a separable inner container (11) with no restriction to the depth of suspension by an annular bead (12) is the fact that the pitch of the bottle thread (17) and collar thread (4) can be chosen independently of each other. In the two-component system described in British Pat. No. 1 083 335, the abutment edge of the collar is screwed into the bottle neck by an amount corresponding to he stroke of the bottle thread. Since at the same time the depth of suspension of the cup is limited by an annular bead abutting on the bottle opening, only limited pressure can be exerted on the weakened point, which means that this weakened point must be sufficiently thin. In practice, however, problems of leaktightness occur particularly with excessively thin weakened points. Since, according to the present invention, the pitch of the collar and bottle threads (4, 17) can be selected independently of each other by using a collar thread (4) with a small pitch, it is possible to exert substantially greater force on the weakened point (10) by means of the abutment edge (7). Therefore, according to the invention, weakened points may be produced from thicker layers of material, resulting in a significant improvement in the leaktightness.

A general advantage of closure caps with a separable inner container (11) is the fact that, after the base (8) or the base tub (25) has been severed, the concentrate (1) enclosed in the reservoir flows out unimpeded, that is, the concentrate (1) and diluent (14) are automatically mixed without any need to shake the bottle.

Everything that has been said makes it clear that the device according to the present invention provides two-component packaging systems with greater leaktightness, safety of use and of improved operation.

The question of the choice of material for the reservoir and the entire closure cap can therefore be resolved in terms of the requirements applying to the concentrate and diluent. The (one-part) inner container may be made of glass, ceramic, plastic, metal, cardboard or other materials, while in the case of inner containers with a weakened point the weakened point may restrict the choice of material Because of the fact that the collar thread also acts as a sealing element, by choosing specific forms of thread and inserting seals or gaskets it is possible to achieve a substantial improvement in leaktightness compared with the known closures.

While the present invention has been illustrated with the aid of certain specific embodiments thereof, it will be readily apparent t others skilled in the art that the invention is not limited to these particular embodiments, and that various changes and modifications may be made without departing from the spirit of the invention or the scope of the appended claims.

I claim:

1. A binary package comprising a container having a threaded bottle neck (2) and adapted to receive a diluent, an inner container (5) forming a reservoir adapted to receive a concentrate (1) which is to be admixed in situ with said diluent, and a threaded closure cap threadedly engaging said bottle neck (2), said closure cap having a base, a bottle thread (17*a*) for engaging the bottle neck (2) and a collar (3) extending radially into the bottle neck (2) from the base of the closure cap, said collar having a collar thread (4) for receiving the inner container (5) and a lower end in the form of an abutment edge (7), the inner container (5) having a flat base (8) and having a weakened line (10), the bottle neck (2) and the inner container (5) both having inner and outer walls, the inner wall of the bottle neck (2) having at least one rotation block (6'), and the outer wall of the inner containers having at least one rotation block (6), said rotation blocks (6,6') cooperating between the outer wall of the inner container (5) and the inner wall of the bottle neck (2) to prevent free rotation of the inner container (5) in at least one direction of rotation, whereby when the binary package is closed the abutment edge (7) rests on the base of the inner container (5), and when the closure cap is rotated further in the direction of closure of the collar thread (4), the inner container is severed along the weakened line (10).

2. The binary package of claim 1, where the inner container (5) has a tub-shaped base (25) provided with an annular step (9) extending about the inner container (5) and having a weakened line (10).

3. A binary package comprising a container having a threaded bottle neck (2) and adapted to receive a diluent, an inner container (5) forming a reservoir adapted to receive a concentrate (1) which is to be admixed in situ with said diluent, and a threaded closure cap threadedly engaging said bottle neck (2), said closure cap having a base, a bottle thread (17*a*) for engaging tee bottle neck (2) and a collar (3) extending radially into the bottle neck (2) from the base of the closure cap, said collar having a collar thread (4) for receiving the inner container (5) and a lower end in the form of an abutment edge (7), the inner container 55) having a flat base (8) having a weakened line (10) and having an annular bead (12) directed radially outwardly and abutting on the bottle neck (2), the annular bead (12) defining depth of suspension of the inner container (5) and blocking free rotation of the inner container (5), whereby when the binary package is closed the abutment edge (7) rests on the base of the inner container (5), and when the closure cap is rotated further in the direction of closure of the collar thread 94), the inner container is severed along the weakened line (10).

4. The binary package of claim 3, said inner container (5) having a tub-shaped base (25) provided with an annular step (9) extending about the inner container (5) and having a weakened line (10).

5. A binary package comprising a container having a threaded bottle neck (2) and adapted to receive a diluent, an inner container (5) forming a reservoir adapted to receive a concentrate (1) which is to be admixed in situ with said diluent, and a threaded closure cap threadedly engaging said bottle neck, said closure cap having a base, a bottle thread (17*a*) for engaging the bottle neck (2) and a collar (3) extending radially into the bottle neck (2) from the base of the closure cap, said collar having a collar thread (4) for receiving the inner container (5), the bottle neck (2) and the inner container (5) both having inner and outer walls, the inner wall of the bottle neck (2) having at least one rotation block (6') and the outer wall of the inner container (5) having at least one rotation block (6), said rotation blocks (6,6') cooperating the outer wall of the inner container (5) and the inner wall of the bottle neck (2) to prevent free rotation of the inner container (5) in at least one direction of rotation, where the collar thread (4) and the bottle thread (17*a*) have different directions of rotation.

6. The binary package of claim 5, wherein the bottle thread (17*a*) comprises at least one thread web (21), whereby the closure cap can be rotated idly in the direction of closure when in the closed position.

7. The binary package of claim 5, where the rotation blocks (6,6') are associated in cooperation with the collar thread (4) to block rotary movement in the direction which leads to unscrewing of the inner container (5) from the collar thread (4).

8. The binary package of claim 5, where the rotation blocks (6,6') cooperate to block rotary movement of the inner container (5) in the direction of closure of the closure cap.

9. The binary package of claim 5, where said closure cap consists of a snap-in base (16) having a base edge member (19) and a snap-in cap (15) having a cap edge member (20), said snap-in base (16) being associated with the collar (3) and the snap-in cap (15) being associated with the bottle thread (17*a*), and the snap-in base (16) and the snap-in cap (15) being connected to each other by means of the base edge member (19) and the cap edge member (20) which can be snapped in.

* * * * *